US008731948B2

(12) United States Patent
Nagel et al.

(10) Patent No.: US 8,731,948 B2
(45) **Date of Patent: *May 20, 2014**

(54) AUDIO SIGNAL SYNTHESIZER FOR SELECTIVELY PERFORMING DIFFERENT PATCHING ALGORITHMS

(75) Inventors: Frederik Nagel, Nuremberg (DE); Sascha Disch, Fuerth (DE); Nikolaus Rettelbach, Nuremberg (DE); Max Neuendorf, Nuremberg (DE); Bernhard Grill, Lauf (DE); Ulrich Kraemer, Stuttgart (DE); Stefan Wabnik, Oldenburg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 482 days.

This patent is subject to a terminal disclaimer.

(21) Appl. No.: 13/004,248

(22) Filed: Jan. 11, 2011

(65) Prior Publication Data

US 2011/0173006 A1 Jul. 14, 2011

Related U.S. Application Data

(63) Continuation of application No. PCT/EP2009/004451, filed on Jun. 19, 2009.

(60) Provisional application No. 61/079,839, filed on Jul. 11, 2008, provisional application No. 61/103,820, filed on Oct. 8, 2008.

(51) Int. Cl.
*G10L 19/00* (2013.01)

(52) U.S. Cl.
USPC ..... 704/500

(58) Field of Classification Search
None
See application file for complete search history.

(56) References Cited

U.S. PATENT DOCUMENTS 5,898,605 A 4/1999 Smarandoiu et al.
6,680,972 B1 * 1/2004 Liljeryd et al. ..... 375/240
6,978,236 B1 * 12/2005 Liljeryd et al. ..... 704/219

(Continued)

FOREIGN PATENT DOCUMENTS

JP 2003-235044 8/2003
JP 2005223533 8/2005

(Continued)

OTHER PUBLICATIONS

Wolters et al. "A closer look into MPEG-4 High Efficiency AAC" 2003.*

(Continued)

*Primary Examiner* — Michael N Opsasnick
(74) *Attorney, Agent, or Firm* — Michael A. Glenn; Perkins Coie LLP

(57) ABSTRACT

An audio signal synthesizer generates a synthesis audio signal having a first frequency band and a second synthesized frequency band derived from the first frequency band and comprises a patch generator, a spectral converter, a raw signal processor and a combiner. The patch generator performs at least two different patching algorithms, each patching algorithm generating a raw signal. The patch generator is adapted to select one of the at least two different patching algorithms in response to a control information. The spectral converter converts the raw signal into a raw signal spectral representation. The raw signal processor processes the raw signal spectral representation in response to spectral domain spectral band replication parameters to obtain an adjusted raw signal spectral representation.

10 Claims, 12 Drawing Sheets

(56) References Cited

U.S. PATENT DOCUMENTS

| | | | | |
|---|---|---|---|---|
| 7,260,520 | B2 * | 8/2007 | Henn et al. | 704/212 |
| 8,015,368 | B2 * | 9/2011 | Sharma et al. | 711/147 |
| 2002/0118845 | A1 * | 8/2002 | Henn et al. | 381/98 |
| 2003/0158726 | A1 * | 8/2003 | Philippe et al. | 704/203 |
| 2004/0078205 | A1 * | 4/2004 | Liljeryd et al. | 704/503 |
| 2004/0125878 | A1 * | 7/2004 | Liljeryd et al. | 375/242 |
| 2004/0131203 | A1 * | 7/2004 | Liljeryd et al. | 381/98 |
| 2004/0138876 | A1 | 7/2004 | Kallio et al. | |
| 2004/0174911 | A1 * | 9/2004 | Kim et al. | 370/538 |
| 2004/0260545 | A1 | 12/2004 | Gao et al. | |
| 2005/0096917 | A1 * | 5/2005 | Kjorling et al. | 704/500 |
| 2005/0165611 | A1 * | 7/2005 | Mehrotra et al. | 704/500 |
| 2005/0177360 | A1 | 8/2005 | Skhejers et al. | |
| 2005/0246164 | A1 * | 11/2005 | Ojala et al. | 704/205 |
| 2006/0190245 | A1 * | 8/2006 | Iser et al. | 704/219 |
| 2007/0016427 | A1 | 1/2007 | Thumpudi et al. | |
| 2007/0106503 | A1 | 5/2007 | Kim et al. | |
| 2007/0174063 | A1 * | 7/2007 | Mehrotra et al. | 704/501 |
| 2007/0299656 | A1 * | 12/2007 | Son et al. | 704/205 |
| 2011/0231195 | A1 * | 9/2011 | Nongpiur et al. | 704/500 |
| 2012/0069899 | A1 | 3/2012 | Mehrotra et al. | |

FOREIGN PATENT DOCUMENTS

| | | | |
|---|---|---|---|
| JP | 2006-180521 | | 7/2006 |
| JP | 2006279333 | | 10/2006 |
| JP | 2007-300455 | | 11/2007 |
| JP | 2008-098751 | | 4/2008 |
| RU | 2204176 | | 5/2003 |
| RU | 2257556 | | 7/2005 |
| RU | 2325046 | | 5/2008 |
| WO | WO 98/57436 | A1 | 12/1998 |
| WO | WO 02/052545 | A1 | 7/2002 |
| WO | WO 2004/044894 | A1 | 5/2004 |
| WO | WO-2005093717 | | 10/2005 |
| WO | WO-2010003479 | | 1/2012 |

OTHER PUBLICATIONS

Hsu et al. "Audio Patch Method in MPEG-4 HE-AAC Decoder" 2004.*

Friedrich et al. "Spectral Band Replication Tool for Very Low Delay Audio Coding Applications" Oct. 21-24, 2007.*

Marpe, Detlez et al., "Context-Based Adaptive Binary Arithmetic Coding in the H.264/AVC Video Compression Standard", IEEE Transactions on Circuits and Systems for Video Technology, vol. 13, No. 7,, Jul. 2003, 620-636.

Meine, et al., "Improved Quantization and Lossless Coding for Sub-band Audio Coding", 118th AES Convention, vol. 1-4, XP040507276, May 31, 2005, pp. 1-9.

Yu, et al., "MPEG-4 Scalable to Lossless Audio Coding", 117th AES Convention, SP040372512, Oct. 2004, pp. 10-14.

* cited by examiner

AUDIO SIGNAL SYNTHESIZER FOR SELECTIVELY PERFORMING DIFFERENT PATCHING ALGORITHMS

CROSS-REFERENCE TO RELATED APPLICATIONS

This application is a continuation of copending PCT Application No. PCT/EP2009/004451 filed Jun. 19, 2009, and claims priority to U.S. Patent Application No. 61/079,839, filed Jul. 11, 2008, and additionally claims priority from U.S. Patent Application No. 61/103,820, filed Oct. 8, 2008, all of which are incorporated herein by reference in their entirety.

BACKGROUND OF THE INVENTION

The present invention relates to an audio signal synthesizer for generating a synthesis audio signal, an audio signal encoder and a data stream comprising an encoded audio signal.

Natural audio coding and speech coding are two major classes of codecs for audio signals. Natural audio coders are commonly used for music or arbitrary signals at medium bit rates and generally offer wide audio bandwidths. Speech coders are basically limited to speech reproduction and may be used at very low bit rate. Wide band speech provides a major subjective quality improvement over narrow band speech. Increasing the bandwidth not only improves the naturalness of speech, but also the speaker's recognition and intelligibility. Wide band speech coding is thus an important issue in the next generation of telephone systems. Further, due to the tremendous growth of the multimedia field, transmission of music and other non-speech signals at high quality over telephone systems as well as storage and, for example, transmission for radio/TV or other broadcast systems is a desirable feature.

To drastically reduce the bit rate, source coding can be performed using split-band perceptual audio codecs. These natural audio codecs exploit perceptual irrelevancy and statistical redundancy in the signal. In case exploitation of the above alone is not sufficient with respect to the given bitrate constraints, the sample rate is reduced. It is also common to decrease the number of composition levels, allowing occasional audible quantization distortion, and to employ degradation of the stereo field through joint stereo coding or parametric coding of two or more channels. Excessive use of such methods results in annoying perceptual degradation. In order to improve the coding performance, bandwidth extension methods such as spectral band replication (SBR) are used as an efficient method to generate high frequency signals in an HFR (high frequency reconstruction) based codec.

In the process of replicating the high frequency signals, a certain transformation may, for example, be applied on the low frequency signals and the transformed signals are then inserted as high frequency signals. This process is also known as patching and different transformations may be used. The MPEG-4 Audio standard uses only one patching algorithm for all audio signals. Hence, it lacks the flexibility to adapt the patching on different signals or coding schemes.

On the one hand, the MPEG-4 standard provides a sophisticated processing of regenerated high-band, in which many important SBR parameters are applied. These important SBR parameters are the data on the spectral envelope, the data on the noise floor to be added to the regenerated spectral portion, information on the inverse filtering tool in order to adapt the tonality of the regenerated high-band to the tonality of the original high-band, and additional spectral band replication processing data such as data on missing harmonics etc. This well-established processing of the replicated spectrum which is provided by a patching of consecutive bandpass signals within the filterbank domain is proven to be efficient to provide high quality and to be implementable with reasonable resources regarding processing power, memory requirements, and power requirements.

On the other hand, patching takes place in the same filterbank as the further processing of the patched signal takes place, so that there is a strong link between the patching operation and the further processing of the result of the patching operation. Therefore, the implementation of different patching algorithms is problematic in this combined approach.

WO 98/57436 discloses transposition methods used in spectral band replication, which are combined with spectral envelope adjustment.

WO 02/052545 teaches that signals can be classified either in pulse-train-like or non-pulse-train-like and based on this classification an adaptive switched transposer is proposed. The switched transposer performs two patching algorithms in parallel and a mixing unit combines both patched signals dependent on the classification (pulse train or non pulse train). The actual switching between or mixing of the transposers is performed in an envelope-adjusting filterbank in response to envelope and control data. Furthermore, for pulse-train-like signals, the base band signal is transformed into a filterbank domain, a frequency translating operation is performed and an envelope adjustment of the result of the frequency translation is performed. This is a combined patching/further processing procedure. For non-pulse-train-like signals, a frequency domain transposer (FD transposer) is provided and the result of the frequency domain transposer is then transformed into the filterbank domain, in which the envelope adjustment is performed. Thus, implementation and flexibility of this procedure which has, in one alternative, a combined patching/further processing approach and which has, in the other alternative, a frequency domain transposer which is positioned outside of the filterbank in which the envelope adjustment takes place is problematic with respect to flexibility and implementation possibilities.

SUMMARY

According to an embodiment, an audio signal synthesizer for generating a synthesis audio signal having a first frequency band and a second synthesized frequency band derived from the first frequency band may have: a patch generator for performing at least two different patching algorithms, wherein each patching algorithm generates a raw signal having signal components in the second synthesized frequency band using an audio signal having signal components in the first frequency band, and wherein the patch generator is adapted to select one of the at least two different patching algorithms in response to a control information for a first time portion and another of the at least two different patching algorithms in response to the control information for a second time portion different from the first time portion to acquire the raw signal for the first and the second time portion outside of a spectral domain; a spectral converter for converting the raw signal for the first and the second time portion from outside of a spectral domain into the spectral domain to acquire a raw signal spectral representation for the first and the second time portion; a raw signal processor for processing the raw signal spectral representation for the first and the second time portion in response to spectral domain spectral band replication parameters to acquire an adjusted raw signal spectral representation for the first and the second time portion; and a combiner for combining the audio signal having signal components in the first band or a signal derived from the audio signal with the adjusted raw signal spectral representation or with a further signal derived from the adjusted raw signal spectral representation to acquire the synthesis audio signal.

According to another embodiment, an audio signal encoder for generating from an audio signal a data stream having components of the audio signal in a first frequency band, control information and spectral band replication parameters may have: a frequency selective filter to generate the components of the audio signal in the first frequency band; a generator for generating the spectral band replication parameter from the components of the audio signal in a second frequency band; a control information generator to generate the control information, the control information identifying a patching algorithm from a first or a second different patching algorithm, wherein each patching algorithm generates a raw signal having signal components in the second replicated frequency band using the components of the audio signal in the first frequency band, wherein the control information generator is adapted to identify the patching algorithm by comparing the audio signal with patched audio signals for the first and for the second patching algorithms, wherein differently patched audio signals are derived from different raw signals related to the first and the second patching algorithms by applying raw signal adjusting in response to spectral band replication parameters with a spectral band replication tool.

According to another embodiment, a method for generating a synthesis audio signal having a first frequency band and a second replicated frequency band derived from the first frequency band may have the steps of: performing at least two different patching algorithms, wherein each patching algorithm generates a raw signal having signal components in the second replicated frequency band using an audio signal having signal components in the first frequency band, and wherein the patching is performed such that one of the at least two different patching algorithms is selected in response to a control information for a first time portion and the other of the at least two different patching algorithms is selected in response to the control information for a second time portion different from the first time portion to acquire the raw signal for the first and the second time portion outside of a spectral domain; converting the raw signal for the first and the second time portion from outside of a spectral domain into the spectral domain to acquire a raw signal spectral representation for the first and the second time portion; processing the raw signal spectral representation for the first and the second time portion in response to spectral domain spectral band replication parameters to acquire an adjusted raw signal spectral representation for the first and the second time portion; and combining the audio signal having signal components in the first band or a signal derived from the audio signal with the adjusted raw signal spectral representation or with a further signal derived from the adjusted raw signal spectral representation to acquire the synthesis audio signal.

According to another embodiment, a method for generating a data stream having components of an audio signal in a first frequency band, control information and spectral band replication parameters may have the steps of: frequency selective filtering the audio signal to generate the components of the audio signal in the first frequency band; generating the spectral band replication parameter from the components of the audio signal in a second frequency band; generating the control information identifying a patching algorithm from a first or a second different patching algorithm, wherein each patching algorithm generates a raw signal having signal components in the second replicated frequency band using the components of the audio signal in the first frequency band, wherein the patching algorithm is identified by comparing the audio signal with patched audio signals for the first and for the second patching algorithms, wherein differently patched audio signals are derived from different raw signals related to the first and the second patching algorithms by applying raw signal adjusting in response to spectral band replication parameters with a spectral band replication tool.

According to another embodiment, a computer program for performing, when running on a processor, a method for generating a synthesis audio signal having a first frequency band and a second replicated frequency band derived from the first frequency band, which method may have the steps of: performing at least two different patching algorithms, wherein each patching algorithm generates a raw signal having signal components in the second replicated frequency band using an audio signal having signal components in the first frequency band, and wherein the patching is performed such that one of the at least two different patching algorithms is selected in response to a control information for a first time portion and the other of the at least two different patching algorithms is selected in response to the control information for a second time portion different from the first time portion to acquire the raw signal for the first and the second time portion outside of a spectral domain; converting the raw signal for the first and the second time portion from outside of a spectral domain into the spectral domain to acquire a raw signal spectral representation for the first and the second time portion; processing the raw signal spectral representation for the first and the second time portion in response to spectral domain spectral band replication parameters to acquire an adjusted raw signal spectral representation for the first and the second time portion; and combining the audio signal having signal components in the first band or a signal derived from the audio signal with the adjusted raw signal spectral representation or with a further signal derived from the adjusted raw signal spectral representation to acquire the synthesis audio signal.

According to another embodiment, a computer program for performing, when running on a processor, a method for generating a data stream having components of an audio signal in a first frequency band, control information and spectral band replication parameters, which method may have the steps of: frequency selective filtering the audio signal to generate the components of the audio signal in the first frequency band; generating the spectral band replication parameter from the components of the audio signal in a second frequency band; generating the control information identifying a patching algorithm from a first or a second different patching algorithm, wherein each patching algorithm generates a raw signal having signal components in the second replicated frequency band using the components of the audio signal in the first frequency band, wherein the patching algorithm is identified by comparing the audio signal with patched audio signals for the first and for the second patching algorithms, wherein differently patched audio signals are derived from different raw signals related to the first and the second patching algorithms by applying raw signal adjusting in response to spectral band replication parameters with a spectral band replication tool.

The present invention is based on the finding that the patching operation on the one hand and the further processing of the output of the patching operation on the other hand have to be completely performed in independent domains. This provides the flexibility to optimize different patching algorithms within a patching generator on the one hand and to use the same envelope adjustment on the other hand, irrespective of the underlying patching algorithm. Therefore, the creation of any patched signal outside of the spectral domain, in which the envelope adjustment takes place, allows a flexible application of different patching algorithms to different signal portions completely independent of the subsequent SBR further processing, and the designer does not have to care about specifics for patching algorithms coming from the envelope adjustment or does not have to care about specifics of the patching algorithms for a certain envelope adjustment. Instead, the different components of spectral band replication, i.e., the patching operation on the one hand and the further processing of the patching result on the other hand can be performed independently from each other. This means that in the entire spectral band replication, the patching algorithm is performed separately, which has the consequence, that the patching and the remaining SBR operations can be optimized independently from each other and are, therefore, flexible with respect to future patching algorithms etc., which can simply be applied without having to change any of the parameters of the further processing of the patching result which is performed in a spectral domain in which any patching does not take place.

The present invention provides an improved quality, since it allows an easy application of different patching algorithms to signal portions so that each signal portion of the base band signal is patched with the patching algorithm which fits to this signal portion in the best way. Furthermore, the straightforward, efficient and high quality envelope adjustment tool which operates in the filterbank and which is well-established and already existent in many applications such as the MPEG-4 HE-AAC can still be used. By separating the patching algorithms from the further processing, such that no patching algorithms are applied in the filterbank domain, in which the further processing of the patching result is performed, the well-established further processing of the patching result can be applied for all available patching algorithms. Optionally the patching may, however, also be carried out in the filterbank as well as in other domains.

Furthermore, this feature provides scalability, since, for low level applications, patching algorithms can be used which make do with less resources while, for high-level applications, patching algorithms can be used which may use more resources, which result in a better audio quality. Alternatively, the patching algorithms can be kept the same, but the complexity of the further processing of the patching result can be adapted to different needs. For low level applications, for example, a reduced frequency resolution for the spectral envelope adjustment can be applied while, for higher-level applications, a finer frequency resolution can be applied which provides a better quality, but which also may use increased resources of memory, processor and power consumption specifically in a mobile device. All this can be done without implications on the corresponding other tool, since the patching tool is not dependent on the spectral envelope adjustment tool and vice versa. Instead, the separation of the patch generation and the processing of the patched raw data by a transform into a spectral representation such as by a filterbank has proven to be an optimum feature.

In accordance with a first aspect of the invention, an audio signal synthesizer generates a synthesis audio signal having a first frequency band and a second synthesized frequency band derived from the first frequency band. The audio signal synthesizer comprises a patch generator, a spectral converter, a raw signal processor and a combiner. The patch generator performs at least two different patching algorithms, wherein each patching algorithm generates a raw signal having signal components in the second synthesized frequency band using an audio signal having signal components in the first frequency band. The patch generator is adapted to select one of the at least two different patching algorithms in response to a control information for a first time portion and another of the at least two different patching algorithms in response to the control information for a second time portion different from the first time portion to obtain the raw signal for the first and the second time portion. The spectral converter converts the raw signal into a raw signal spectral representation. The raw signal processor processes the raw signal spectral representation in response to spectral domain spectral band replication parameters to obtain an adjusted raw signal spectral representation. The combiner combines an audio signal having signal components in the first band or a signal derived from the audio signal with the adjusted raw signal spectral representation or with a further signal derived from the adjusted raw signal spectral representation to obtain the synthesis audio signal.

In further embodiments the audio signal synthesizer is configured so that the at least two patching algorithms are different from each other in that a signal component of the audio signal at a frequency in the first frequency band is patched to a target frequency in the second frequency band, and the target frequency is different for both patching algorithms. The patch generator may be further adapted to operate in the time domain for both patching algorithms.

In accordance with another aspect of the present invention, an audio signal encoder generates from an audio signal a data stream comprising components of the audio signal in a first frequency band, control information and spectral band replication parameters. The audio signal encoder comprises a frequency selective filter, a generator and a control information generator. The frequency selective filter generates the components of the audio signal in the first frequency band. The generator generates the spectral band replication parameter from the components of the audio signal in a second frequency band. The control information generator generates the control information, the control information identifying an advantageous patching algorithm from a first or a second different patching algorithm. Each patching algorithm generates a raw signal having signal components in the second replicated frequency band using the components of the audio signal in the first frequency band.

In accordance with yet another aspect of the present invention, an audio signal bit stream transmitted over a transmission line connected to a computer comprises an encoded audio signal in the first frequency band, control information and the spectral band replication parameters Therefore, the present invention relates to a method for switching between different patching algorithms in spectral band replication, wherein the used patching algorithm depends on encoder side on a decision made in the encoder and, on decoder side, on information transmitted in the bitstream. By employing a spectral band replication (SBR), the generation of the high frequency components may, for example, be done by copying the low frequency signal components in a QMF-filter bank (QMF=Quadrature Mirror Filter) onto high frequency bands. This copying is also known as patching and according to embodiments of the present invention this patching is replaced or supplemented by alternative methods, which may also be performed in the time domain. Examples for the alternative patching algorithms are:

(1) Up sampling (e.g. by mirroring of the spectrum);

(2) Phase vocoder;

(3) Non-linear distortion;

(4) Mirroring of the spectrum in the QMF-domain by exchanging the QMF-band order;

(5) Model driven (in particular for speech); and (6) Modulation

The alternative patching algorithms may also be performed within the encoder, in order to obtain the spectral band replication parameters, which are used, e.g., by SBR tools like noise filling, inverse filtering, missing harmonics, etc. According to embodiments, the patching algorithm within a patching generator is replaced while still using the remaining spectral band replication tools.

The concrete choice for the patching algorithm depends on the applied audio signal. For example, the phase vocoder severely alters the characteristic of speech signals and therefore the phase vocoder does not provide a suitable patching algorithm, for example, for speech or speech-like signals. Hence, depending on the audio signal type, a patch generator selects a patching algorithm out of different possibilities for generating patches for the high frequency band. For example, the patch generator can switch between the conventional SBR tool (copy of QMF bands) and the phase vocoder or any other patching algorithms.

In contrast to the conventional SBR-implementation (for example implemented in MPEG-4) embodiments of the present invention thus use the patching generator for generating the high frequency signal. The patching generator may not only operate in the frequency, but also in the time domain and implements patching algorithms as for example: mirroring and/or up sampling and/or a phase vocoder and/or non-linear distortion. Whether the spectral band replication is done in the frequency or in the time domain depends on the concrete signal (i.e. it is signal adaptive), which will be explained in more detail below.

Spectral band replication relies on the fact that for many purposes it is sufficient to transmit an audio signal only within a core frequency band and to generate the signal components in the upper frequency band in the decoder. The resulting audio signal will still maintain a high perceptual quality, since for speech and music for example, high frequency components often have a correlation with respect to the low frequency components in the core frequency band. Therefore, by using an adapted patching algorithm, which generates the missing high frequency components, it is possible to obtain an audio signal in high perceptual quality. At the same time, the parameter driven generation of the upper bands results in a significant decrease of the bit rate to encode an audio signal, because only the audio signal within the core frequency band is encoded compressed and transmitted to the decoder. For the remaining frequency components only control information and spectral band replication parameters are transmitted, which control the decoder in the process of generating an estimate of the original highband signal. So, strictly speaking this process involves three aspects: (i) the parametric HF band estimation (calculation of SBR parameter), (ii) the raw patch generation (actual patching) and (iii) provisions for further processing (e.g. noise floor adjustment).

The core frequency band may be defined by the so-called crossover frequency, which defines a threshold within the frequency band up to which an encoding of the audio signal is performed. The core coder encodes the audio signal within the core frequency band limited by the cross-over frequency. Starting with the crossover frequency, the signal components will be generated by the spectral band replication. In using conventional methods for the spectral band replication, it often happens that some signals comprise unwanted artifacts at the crossover frequency of the core coder.

By using embodiments of the present invention, it is possible to determine a patching algorithm, which avoids these artifacts or at least modifies these artifacts in a way that they do not have a perceptual effect. For example, by using mirroring as patching algorithm in the time domain the spectral band replication is performed similarly to the bandwidth extension (BWE) within AMR-WB+ (extended adaptive multi-rate wide band codec). In addition, the possibility to change the patching algorithm depending on the signal offers the possibility that for speech and for music, for example, different bandwidth extensions can be used. But also for a signal that cannot be clearly identified as music or speech (i.e. mixed signal) the patching algorithm can be changed within short time periods. For example, for any given time period an advantageous patching algorithm may be used for the patching. This advantageous patching algorithm may be determined by the encoder that may, for example, compare for each processed block of input data the patching results with the original audio signal. This improves significantly the perceptive quality of the resulting audio signal generated by the audio signal synthesizer.

Further advantages of the present invention are due to the separation of the patching generator from the raw signal processor, which may comprise standard SBR tools. Due to this separation, the usual SBR tools can be employed, which may comprise an inverse filtering, adding a noise floor or missing harmonics or others. Therefore, the standard SBR-tools can still be used while the patching can be adjusted flexibly. In addition, since the standard SBR-tools are used in the frequency domain, separating the patch generator from the SBR-tools, allows for a computation of the patching either in the frequency domain or in the time domain.

BRIEF DESCRIPTION OF THE DRAWINGS

Embodiments of the present invention will be detailed subsequently referring to the appended drawings, in which.

The present invention will now be described by way of illustrated examples. Features of the invention will be more readily appreciated and better understood by reference to the following detailed description, which should be considered with reference to the accompanying drawings, in which.

DETAILED DESCRIPTION OF THE INVENTION

The embodiments described below are merely illustrative for the principle of the present invention for improving the spectral band replication, for example used with an audio decoder. It is understood that modifications and variations of the arrangements and the details described herein will be apparent to others skilled in the art. It is the intent, therefore, not to be limited by the specific details presented by way of the description and the explanation of embodiments herein.

Figure 1:
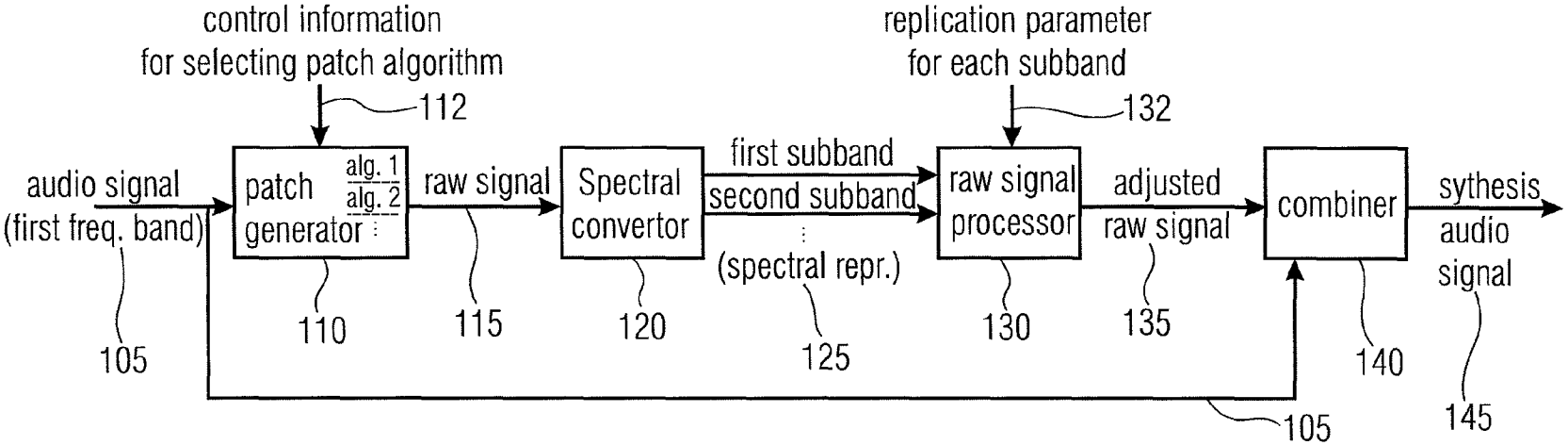
FIG. 1 shows a block diagram of an audio signal processing according to embodiments of the present invention.

FIG. 1 shows an audio signal synthesizer for generating a synthesis audio signal 105 having a first frequency band and a second replicated frequency band derived from the first frequency band. The audio signal synthesizer comprises a patch generator 110 for performing at least two different patching algorithms, wherein each patching algorithm generates a raw signal 115 having signal components in the second replicated frequency band using the audio signal 105 having signal components in the first frequency band. The patch generator 110 is adapted to select one of the, at least, two different patching algorithms in response to a control information 112 for a first time portion and the other of the, at least, two different patching algorithms in response to the control information 112 for a second time portion different from the first time portion to obtain the raw signal 115 for the first and the second time portion. The audio signal synthesizer further comprises a spectral converter 120 for converting the raw signal 115 into a raw spectral representation 125 comprising components in a first subband, a second subband, and so on. The audio signal synthesizer further comprises the raw signal processor 130 for processing the raw spectral representation 125 in response to spectral domain spectral band replication parameters 132 to obtain an adjusted raw signal spectral representation 135. The audio signal synthesizer further comprises a combiner 140 for combining the audio signal 105 having signal components in the first band or a signal derived from the audio signal 105 with the adjusted raw signal spectral representation 135 or with a further signal derived from the adjusted raw signal spectral representation 135 to obtain the synthesis audio signal 145.

In further embodiments the combiner 140 is adapted to use as the signal derived from the audio signal 105 the raw signal spectral representation 125. The signal derived from the audio signal used by the combiner can also be the audio signal processed by a time/spectral converter such as an analysis filterbank or a low band signal as generated by a patch generator operating in the time domain or in the spectral domain or a delayed audio signal or the audio signal processed by an upsampling operation so that the signals to be combined have the same underlying sampling rate.

In yet another embodiment the audio signal synthesizer further comprises an analyzer for analyzing a characteristic of the audio signal 105 having signal components in the first frequency band 201 and to provide the control information 112, which identifies the first patching algorithm or the second patching algorithm.

In further embodiments the analyzer is adapted to identify a non-harmonic patch algorithm for a time portion having a degree of voice or a harmonic patch algorithm for a distinguished time portion in the audio signal 105.

In yet further embodiments the audio signal 105 is encoded together with meta data into a data stream, and wherein the patch generator 110 is adapted to obtain the control information 112 from the meta data in the data stream.

In yet further embodiments the spectral converter 120 comprises an analysis filter bank or the at least two different patching algorithms comprise a phase vocoder algorithm or an up sampling patching algorithm or a non-linear distortion patching algorithm or a copying algorithm.

In yet further embodiments the raw signal processor 130 is adapted to perform an energy adjustment of the spectral bands or an inverse filtering in the spectral bands or to add a noise floor to the spectral band or to add missing harmonics to the spectral band.

Figure 2:
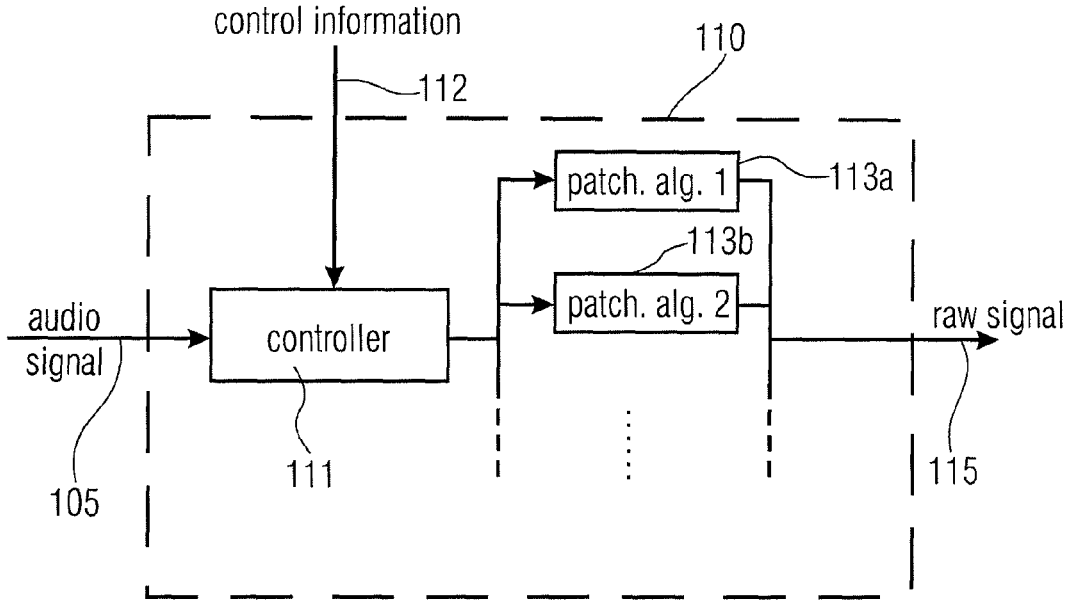
FIG. 2 shows a block diagram for the patch generator according to embodiments.

FIG. 2 shows a block diagram giving more details for the patch generator 110 comprising a controller, which receives the control information 112 and the audio signal 105, and patching means 113. The controller 111 is adapted to select a patch algorithm based on the control information 112. The patch generator 110 comprises a first patching means 113*a* performing a first algorithm 1, a second patching means 113*b* performing a second patching algorithm 2, and so on. In general, the patch generator 110 comprises as many patching means 113 as patching algorithms are available. For example, the patching generator 110 may comprise two, three, four or more than four patching means 113. After the controller 111 has based on the control information 112 selected one of the patching means 113 the controller 111 sends the audio signal 105 to the one of the patching means 113, which performs the patching algorithm and outputs the raw signal 115, which comprises signal components in the replicated frequency bands 202, 203.

Figure 3:
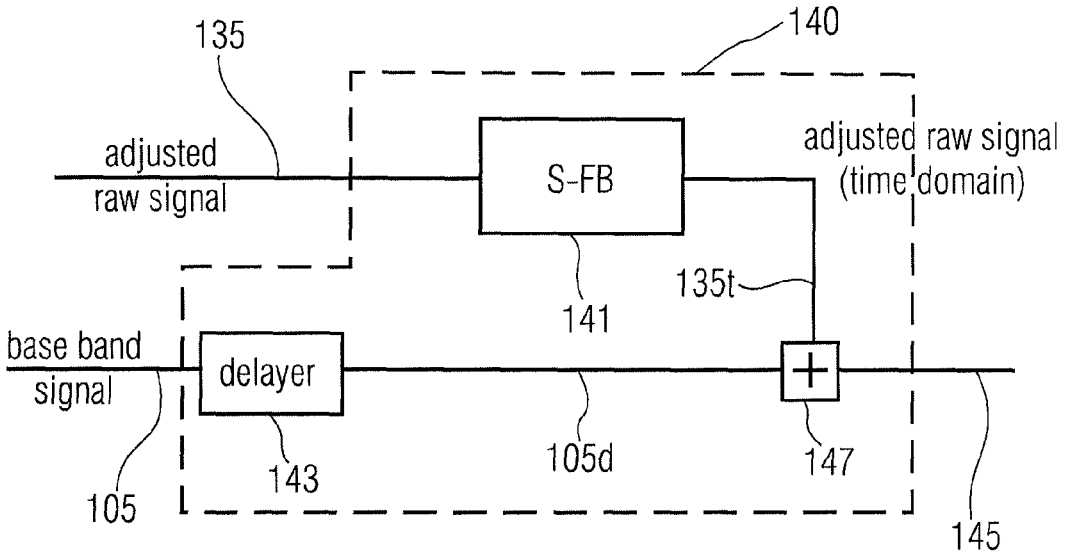
FIG. 3 shows a block diagram for the combiner operating in the time domain.

FIG. 3 shows a block diagram giving more details for the combiner 140, wherein the combiner 140 comprises a synthesis filter bank 141, a delayer 143 and an adder 147. The adjusted raw signal 135 is input into the synthesis filter bank 141, which generates from the adjusted raw signal 135 (e.g. in the spectral representation) an adjusted raw signal within the time domain 135*t* (time domain raw signal). The base band audio signal 105 is input into the delayer 143, which is adapted to delay the base band signal 105 by a certain period of time and outputs the delayed base band signal 105*d*. The delayed base band signal 105*d* and the time domain adjusted raw signal 135*t* are added by the adder 147 yielding the synthesis audio signal 145, which is output out of the combiner 140. The delay in the delayer 143 depends on the processing algorithm of the audio signal synthesizer in order to achieve that the time domain adjusted raw signal 135*t* will correspond to the same time as the delayed base band signal 105*d* (synchronization).

FIGS. 4*a* to 4*d* show different patching algorithms used in the patch generator 110 by the patching means 113. As explained above, the patching algorithm generates a patched signal in the replicated frequency band. In the embodiments as shown in FIG. 4, a first frequency band 201 extends to the crossover frequency $f_{max}$ at which a second frequency band 202 (or second replicated frequency band) starts and extends to twice the crossover frequency $2*f_{max}$. Beyond this frequency, a third frequency band 203 (or third replicated frequency band) begins. The first frequency band 201 may comprise the aforementioned core frequency band.

Figure 4:
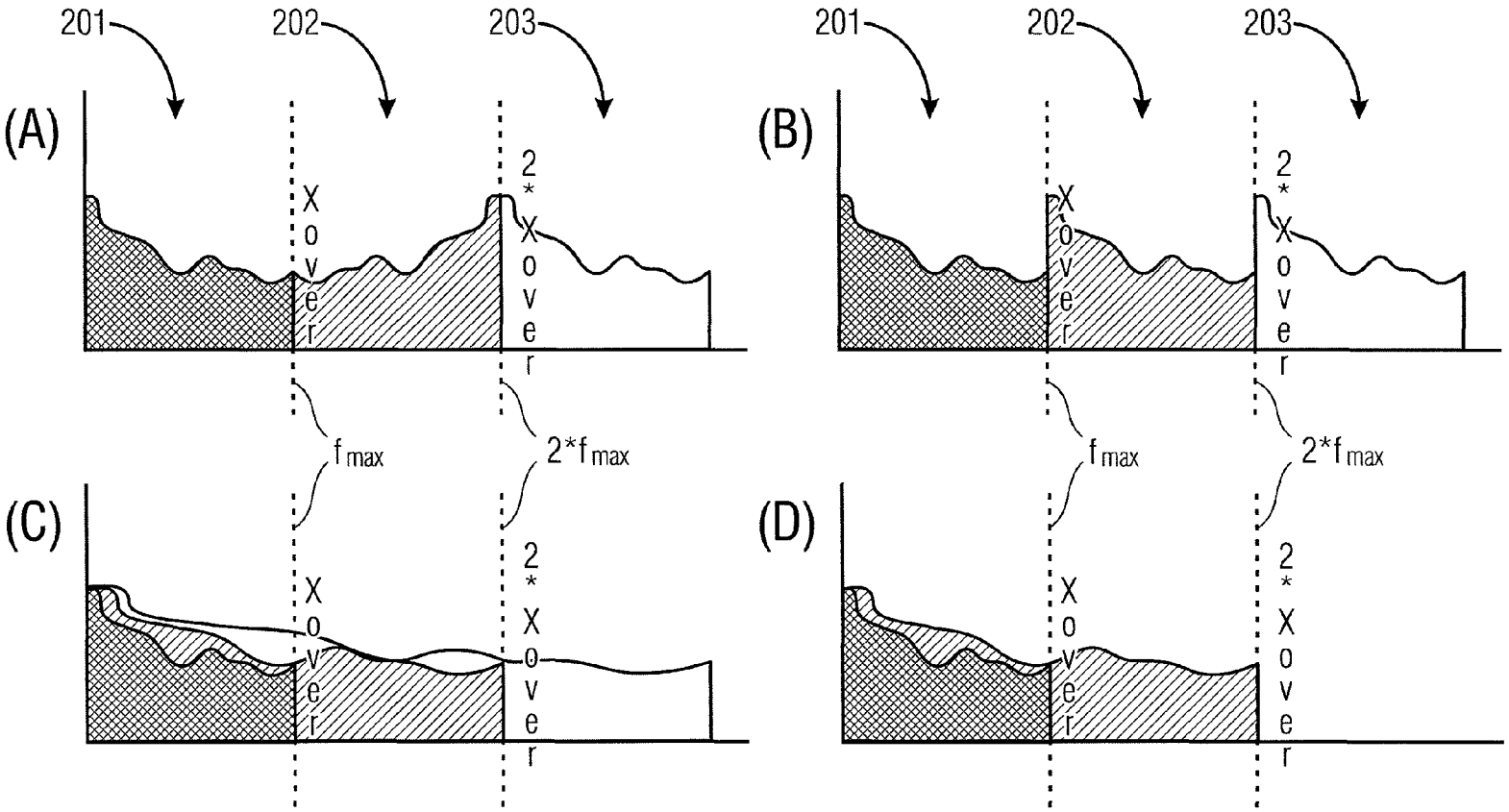
FIGS. 4*a* to 4*d* illustrate schematically examples for different patching algorithms.

In FIG. 4, four patching algorithms are shown as examples. The first patching algorithm in FIG. 4*a* comprises a mirroring or up sampling, a second patching algorithm comprises a copying or modulating and is shown in FIG. 4*b*, a third patching algorithm comprises a phase vocoder is shown in FIG. 4*c*, and a fourth patching algorithm comprising a distortion is shown in FIG. 4*d*.

The mirroring as shown in FIG. 4*a* is performed such that the patched signal in the second frequency band 202 is obtained by mirroring the first frequency band 201 at the cross over frequency $f_{max}$. The patched signal in the third frequency band 203 is, in turn, obtained by mirroring the signal in the second frequency band 202. Since the signal in the second frequency band 202 was already a mirrored signal, the signal in the third frequency band 203 may also be obtained simply by shifting the audio signal 105 in the first frequency band 201 into the third frequency band 203.

A second patching algorithm as shown in FIG. 4 implements the copying (or modulating) the signal. In this embodiment the signal in the second frequency band 202 is obtained by shifting (copying) the signal in the first frequency band 201 into the second frequency band 202. Similarly, also the signal in the third frequency band 203 is obtained by shifting the signal in the first frequency band 201 into the third frequency band 203.

FIG. 4*c* shows an embodiment using a phase vocoder as patching algorithm. The patched signal is generated by subsequent steps, wherein a first step generates signal components up twice the maximal frequency $2*f_{max}$ and second step generates signal components up three times the maximal frequency $3*f_{max}$ and so on. A phase vocoder multiplies the frequencies of samples with a factor n (n=2, 3, 4, . . . ) yielding a spreading of the sample values over n-times frequency range of the core frequency band (first frequency band 201).

The patching algorithm using distortion (for example, by squaring the signal) is shown in FIG. 4*d*. Distortions can be obtained by many ways. A simple way is by squaring the signal level generating higher frequency components. Another possibility of distortion is obtained by clipping (e.g. by cutting the signal above a certain threshold). Also in this case high frequency components will be generated. Basically any distortion known in conventional methods may be used here.

Figure 5A:
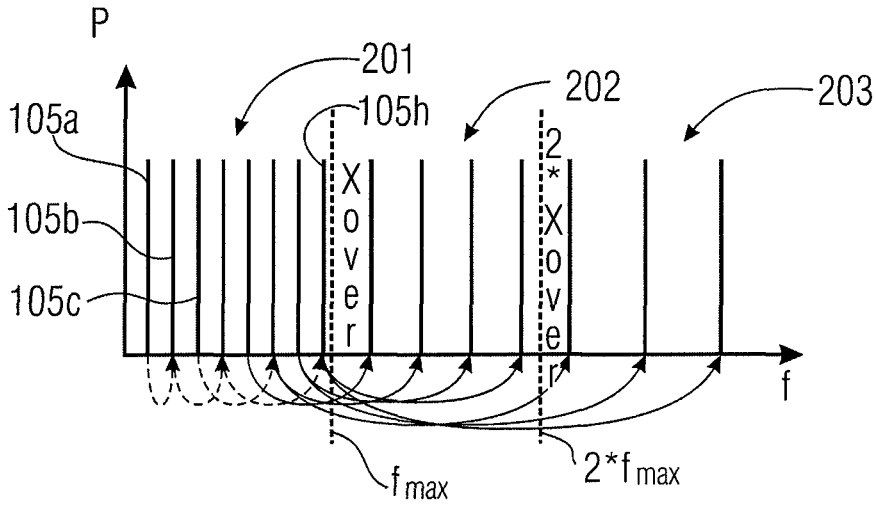
FIGS. 5*a* and 5*b* illustrate the phase vocoder and the patching by copying.

FIG. 5*a* shows, in more detail, the patching algorithm of a phase vocoder. The first frequency band 201 extends again up to the maximal frequency $f_{max}$ (cross-over frequency) at which the second frequency band 202 begins, which ends, for example, at twice the maximal frequency $2*f_{max}$. After the second frequency band 202, the third frequency band 203 starts and may, for example, extend up to three times the maximal frequency $3*f_{max}$.

For simplicity FIG. 5*a* shows a spectrum (level P as function of the frequency f) with eight frequency lines 105*a*, 105*b*, . . . , 105*h* for the audio signal 105. From these eight lines 105*a*, . . . , 105*h* the phase vocoder generates a new signal by shifting the lines in accordance with the shown arrows. The shifting corresponds to the aforementioned multiplication. In detail, the first line 105*a* is shifted to the second line 105*b*, the second line is shifted to the fourth line, and so on, up to the eighth line 105*h*, which is shifted to the $16^{th}$ line (last line in the second frequency domain 202). This corresponds to the multiplication by two. In order to generate lines up to three times the maximal frequency, $3*f_{max}$, all frequencies of the lines may be multiplied by three, i.e. the first line 105*a* is shifted to the third line 105*c*, the second line 105*b* is shifted to the sixth line, and so on, up to the eighth line 105*h*, which is shifted to the $24^{th}$ line (the last line in the third frequency band 203). It is obvious that by this phase vocoder, the lines are no longer equidistant, but they are spread for higher frequencies.

Figure 5B:
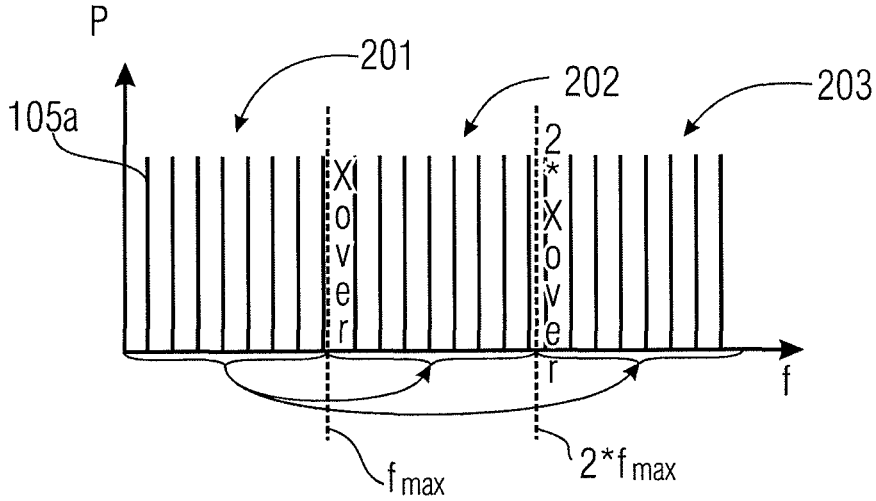

FIG. 5*b* shows the patching of copying in more detail. Again, the level P as function of the frequency f is shown, wherein eight lines are in the first frequency band 201, which are copied into the second frequency band 202 and also into the third frequency band 203. This copying just implies that the first line 105*a* in the first frequency band 201 becomes also the first line in the second frequency band 202 and in the third frequency band 203. Hence, the first lines of each of the replicated frequency bands 202 and 203 are copied from the same line in the first frequency band 201. In analogy this applies also to the other lines. Consequently, the whole frequency band is copied.

The different patching algorithms as shown in FIGS. 4 and 5 may be applied differently, either within the time domain or in the frequency domain and comprise different advantages or drawbacks, which can be exploited for different applications.

For example, the mirroring in the frequency domain is shown in FIG. 4*a*. In the time domain the mirroring can be performed by increasing the sample rate by an integer factor, which can be done by inserting additional samples between each pair of existing samples. These additional samples are not obtained from the audio signal, but are introduced by the system and comprise, for example, values close to or equal to zero. In the simplest case, if only one additional sample is introduced between two existing samples, a doubling of the number of samples is achieved implying a doubling of the sampling rate. If more than one further samples are introduced (e.g. in an equidistant way) the sample rate will increase accordingly and hence also the frequency spectrum is increased. In general, the number of further samples between each two existing samples can be any number n (n=2, 3, 4 . . . ) increasing the sample rate by the factor n+1. The insertion of the additional samples yields the mirroring of the frequency spectrum at the Nyquist frequency, which specifies the highest representable frequency at a given sampling rate. The frequency domain of the base band spectrum (spectrum in the first frequency band) is thus mirrored by this procedure directly into the next frequency band. Optionally, this mirroring can be combined with a possible low-pass filtering and/or a spectral shaping.

Advantages of this patching algorithm can be summarized as follows. Using this method, the signal time structure is better preserved than using similar methods in the frequency domain. Moreover, by spectral mirroring frequency lines close to the Nyquist frequency are mapped onto lines, which are also close to the Nyquist frequency. This is an advantage, because after mirroring the spectral regions around the mirroring frequency (i.e. the Nyquist frequency of the original audio signal 105) are similar in many respects, as for example, with respect to the property of the spectral flatness, the tonal property, the accumulation or the distinctness of frequency points, etc. By this method, the spectrum is continued to the next frequency band in a more moderate way as, for example, by using the techniques of copying, in which frequency regions end up close to each other, which originate from completely different regions in the original spectrum and thus display very different characteristics. In copying: the first sample becomes again the first sample in the replicated band, whereas in mirroring the last sample becomes the first sample in the replicated band. This softer continuation of the spectrum can in turn reduce perceptual artifacts, which are caused by non-continuous characteristics of the reconstructed spectrum generated by other patching algorithms.

Finally, there are signals, which comprise a high number of harmonics, for example, in the lower frequency region (first frequency band 201). These harmonics appear as localized peaks in the spectrum. In the upper part of the spectrum, there may, however, only be very few harmonics present or, in other words, the number of harmonics is smaller in the upper part of the spectrum. By simply using a copying of the spectrum, this would result in a replicated signal in which the lower part of the spectrum with a high number of harmonics is copied directly into the upper frequency region where there were only very few harmonics in the original signal. As a result the upper frequency band of the original signal and the replicated signal are very different regarding the number of harmonics, which is undesired and should be avoided.

The patching algorithm of mirroring can also be applied in the frequency domain (for example, in the QMF-region), in which case the order in the frequency bands are inverted so that a reordering from back to forth happens. In addition, for sub-band samples, a complex conjugate value has to be formed so that the imaginary part of each sample changes its sign. This yields an inversion of the spectrum within the sub-band.

This patching algorithm comprises a high flexibility with respect to the borders of the patch, since a mirroring of the spectrum is not necessarily to be done at the Nyquist frequency, but may also be performed at any sub-band border.

The aliasing cancellation between neighboring QMF-bands at the edges of patches may, however, not happen, which may or may not be tolerable.

By spreading or by using the phase vocoder (see FIG. 4*c* or 5*a*) the frequency structure is harmonically correctly extended into the high frequency domain, because the base band 201 is spectrally spread by an even multiple performed by one or more phase vocoders, and because spectral components in the base band 201 are combined with the additional generated spectral components.

This patching algorithm is advantageous if the base band 201 is already strongly limited in bandwidth, for example, by using only a very low bit rate. Hence, the reconstruction of the upper frequency components starts already at a relatively low frequency. A typical crossover frequency is, in this case, less than about 5 kHz (or even less than 4 kHz). In this region, the human ear is very sensitive to dissonances due to incorrectly positioned harmonics. This can result in the impression of "unnatural" tones. In addition, spectrally closely spaced tones (with a spectral distance of about 30 Hz to 300 Hz) are perceived as rough tones. A harmonic continuation of the frequency structure of the base band 201 avoids these incorrect and unpleasant hearing impressions.

In the third patching algorithm of copying (see FIG. 4*c* or 5*b*) spectral regions are sub-band wise copied into a higher frequency region or into the frequency region to be replicated. Also copying relies on the observation, which is true for all patching methods, that the spectral properties of the higher frequency signals are similar in many respects to the properties of the base band signals. There are only very few deviations from each other. In addition, the human ear is typically not very sensitive at high frequency (typically starting at about 5 kHz), especially with respect to a non-precise spectral mapping. In fact this is the key idea of the spectral band replication in general. Copying in particular comprises the advantage that it is easy and fast to implement.

This patching algorithm also has a high flexibility with respect to the borders of the patch, since the copying of the spectrum may be performed at any sub-band border.

Finally, the patching algorithm of distortion (see FIG. 4*d*) may comprise the generation of harmonics by clipping, limiting, squaring, etc. If, for example, a spread signal is spectrally very thinly occupied (e.g. after applying the above mentioned phase vocoder patching algorithm), it is possible that the spread spectrum can optionally be additively supplemented by a distorted signal in order to avoid unwanted frequency holes.

FIGS. 6*a* to 6*d* show different embodiments for the audio signal synthesizer implemented in an audio decoder.

Figure 6A:
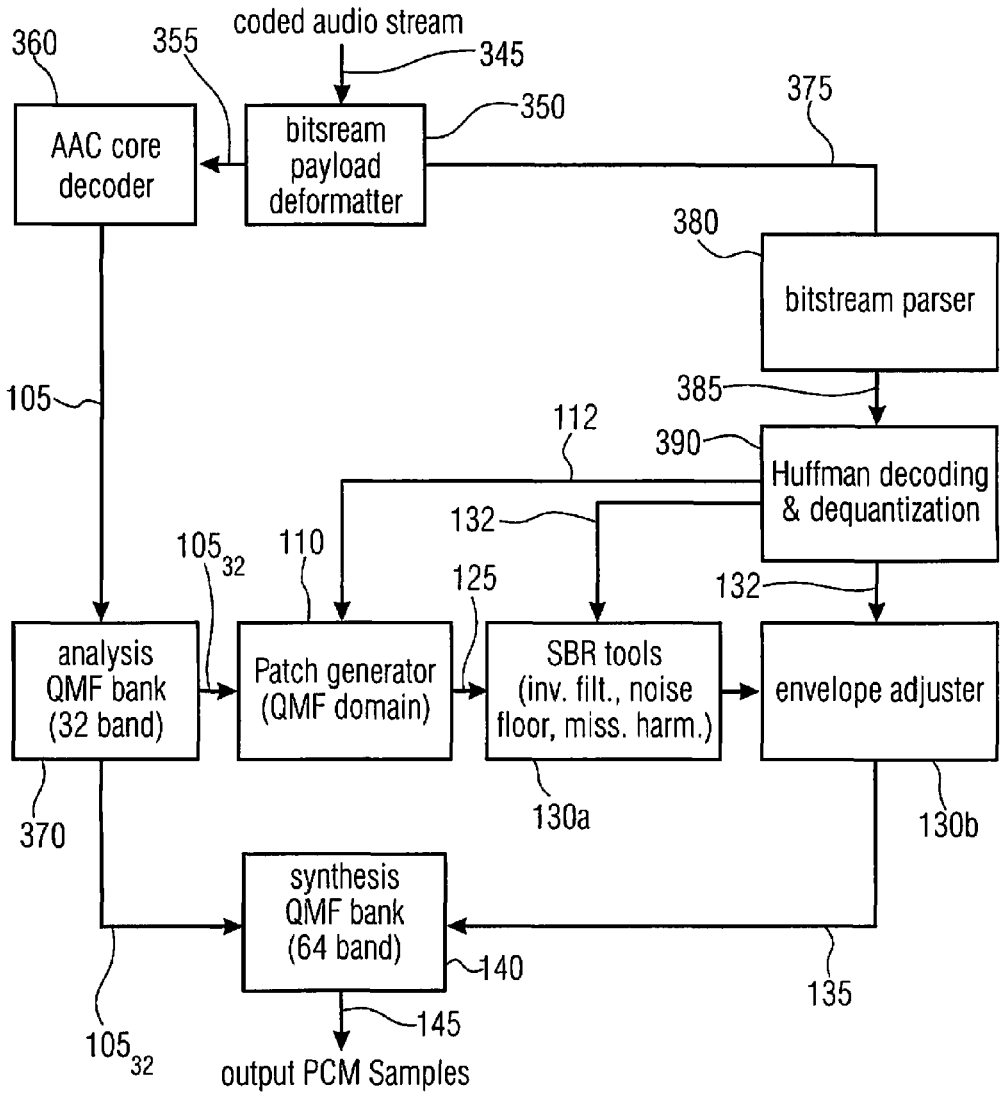
FIG 6A (PRIOR ART)
FIGS. 6*a* to 6*d* show block diagrams for processing the coded audio stream to output PCM samples.

In the embodiment shown in FIG. 6*a*, a coded audio stream 345 is input into a bit stream payload deformatter 350, which separates on one hand a coded audio signal 355 and on the other hand additional information 375. The coded audio signal 355 is input into, for example, an AAC core decoder 360, which generates the decoded audio signal 105 in the first frequency band 201. The audio signal 105 is input into an analysis 32 band QMF-bank 370, comprising, for example, 32 frequency bands and which generates the audio signal $\mathbf{105}_{32}$ in the frequency domain. It is advantageous that the patch generator only outputs a high band signal as the raw signal and does not output the low band signal. If, alternatively, the patching algorithm in block 110 generates the low band signal as well, it is advantageous to high pass filter the input signal into block 130*a*.

The frequency domain audio signal $\mathbf{105}_{32}$ is input into the patch generator 110, which in this embodiment generates the patch within the frequency domain (QMF-domain). The resulting raw signal spectral representation 125 is input into an SBR tool 130*a*, which may, for example, generate a noise floor, reconstruct missing harmonics or perform an inverse filtering.

On the other hand, the additional information 375 is input into a bit stream parser 380, which analyzes the additional information to obtain different sub-information 385 and input them into, for example, an Huffman decoding and dequantization unit 390 which, for example, extracts the control information 112 and the spectral band replication parameters 132. The control information 112 is input into the SBR tool and the spectral band replication parameters 132 are input into the SBR tool 130*a* as well as into an envelope adjuster 130*b*. The envelope adjuster 130*b* is operative to adjust the envelope for the generated patch. As a result, the envelope adjuster 130*b* generates the adjusted raw signal 135 and inputs it into a synthesis QMF-bank 140, which combines the adjusted raw signal 135 with the audio signal in the frequency domain $\mathbf{105}_{32}$. The syntheses QMF-bank may, for example, comprise 64 frequency bands and generates by combining both signals (the adjusted raw signal 135 and the frequency domain audio signal $\mathbf{105}_{32}$) the synthesis audio signal 145 (for example, an output of PCM samples, PCM=pulse code modulation).

In addition, FIG. 6*a* shows the SBR tools 130*a*, which may implement known spectral band replication methods to be used on the QMF spectral data output of the patch generator 110. The patching algorithm used in the frequency domain as shown in FIG. 6*a* could, for example, employ the simple mirroring or copying of the spectral data within the frequency domain (see FIG. 4*a* and FIG. 4*b*).

This general structure agrees thus with conventional decoders known in conventional technology, but embodiments replace the conventional patch generator by the patch generator 110, configured to perform different adapted patching algorithms in order to improve the perceptual quality of the audio signal. In addition, embodiments may also use a patching algorithm within the time domain and not necessarily the patching in the frequency domain as shown in FIG. 6*a*.

Figure 6B:
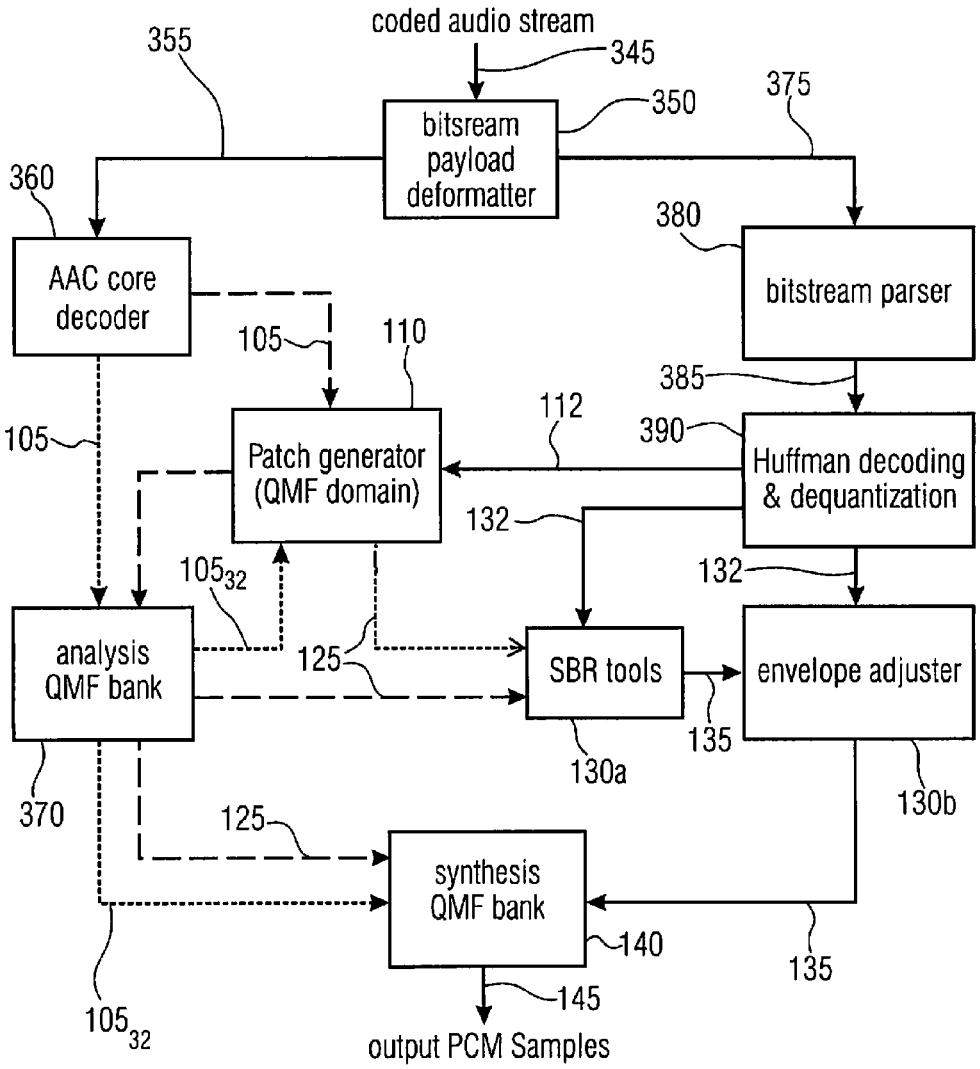

FIG. 6*b* shows embodiments of the present invention in which the patching generator 110 may use a patching algorithm within the frequency as well as within the time domain. The decoder as shown in FIG. 6*b* again comprises the bit stream payload deformatter 350, the AAC core decoder 360, the bit stream parser 380, and the Huffman decoding and dequantization unit 390. Therefore, in the embodiment as shown in FIG. 6*b*, the coded audio stream 345 is again input into the bit stream payload deformatter 350, which on the one hand generates the coded audio signal 355 and separates from it the additional information 375, which is afterwards parsed by the bit stream parser 380 to separate the different information 385, which are input into the Huffman decoding and dequantization unit 390. On the other hand, the coded audio signal 355 is input into the AAC core decoder 360.

Embodiments now distinguish the two cases: the patch generator 110 operates either within the frequency domain (following dotted signal lines) or within the time domain (following dashed signal lines).

If the patch generator operates in the time domain, the output of the AAC core decoder 360 is input into the patch generator 110 (dashed line for audio signal 105) and its output is transmitted to the analysis filter bank 370. The output of the analysis filter bank 370 is the raw signal spectral representation 125, which is input into the SBR tools 130*a* (which is a part of the raw signal adjuster 130) as well as into synthesis QMF bank 140.

If, on the other hand the patching algorithm uses the frequency domain (as shown in FIG. 6*a*), the output of the AAC core decoder 360 is input into the analysis QMF-bank 360 via the dotted line for the audio signal 105, which, in turn, generates a frequency domain audio signal $\mathbf{105}_{32}$ and transmits the audio signal $\mathbf{105}_{32}$ to the patch generator 110 and to the synthesis QMF Bank 140 (dotted lines). The patch generator 110 generates again a raw signal representation 125 and transmits this signal to the SBR tools 130*a*.

Hence, the embodiment either performs a first processing mode using the dotted lines (frequency domain patching) or a second processing mode using the dashed lines (time domain patching), where all solid lines between other functional elements are used in both processing modes.

It is advantageous that the time processing mode of the patch generator (dashed lines) is so that the output of the patch generator includes the low band signal and the high band signal, i.e., that the output signal of the patch generator is a broadband signal consisting of the low band signal and the high band signal. The low band signal is input into block 140 and the high band signal is input into block 130*a*. The band separations may be performed in the analysis bank 370, but can be performed alternatively as well. Furthermore, the AAC decoder output signal can be fed directly into block 370 so that the low band portion of the patch generator output signal is not used at all and the original low band portion is used in the combiner 140.

In the frequency domain processing mode (dotted lines), the patch generator advantageously only outputs the high band signal, and the original low band signal is fed directly to block 370 for feeding the synthesis bank 140. Alternatively, the patch generator can also generate a full bandwidth output signal and feed the low band signal into block 140.

Again, the Huffman decoding and dequantization unit 390 generates the spectral band replication parameter 132 and the control information 112, which is input into the patch generator 110. In addition, the spectral band replication parameters 132 are transmitted to the envelope adjuster 130*b* as well as to the SBR tools 130*a*. The output of the envelope adjuster 130*b* is the adjusted raw signal 135 which is combined in the combiner 140 (synthesis QMF bank) with the spectral band audio signal $\mathbf{105}_{32}$ (for the frequency domain patching) or with raw signal spectral representation 125 (for the time domain patching) to generate the synthesis audio signal 145, which again may comprise output PCM samples.

Also in this embodiment the patch generator 110 uses one of the patching algorithms (as, for example, shown in FIGS. 4*a* to 4*d*) in order to generate the audio signal in the second frequency band 202 or the third frequency band 203 by using the base band signal in the first frequency band 201. Only the audio signal samples within the first frequency band 201 are encoded in the coded out stream 345 and the missing samples are generated by using the spectral band replication method.

Figure 6C:
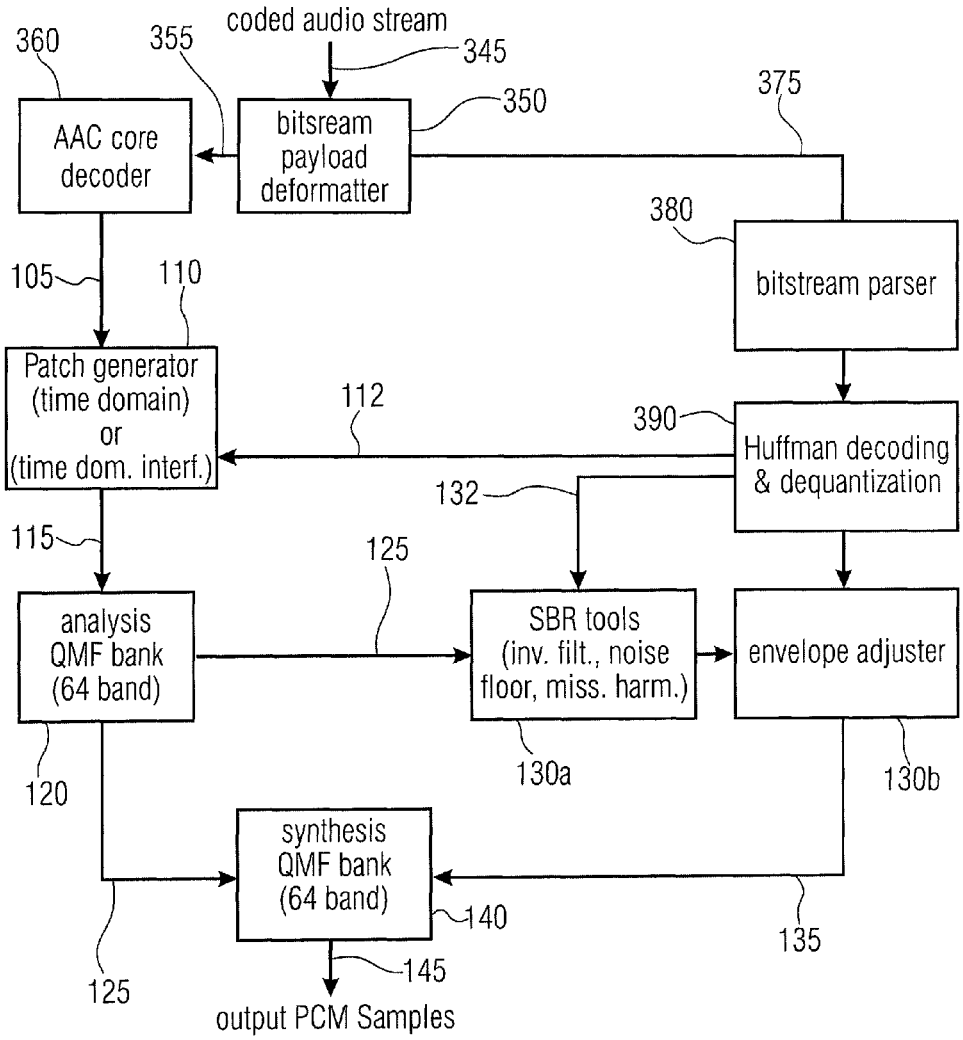

FIG. 6*c* shows an embodiment for the patching algorithm within the time domain. In comparison to FIG. 6*a*, the embodiment as shown in FIG. 6*c* differs by the position of the patch generator 110 and the analysis QMF bank 120. All remaining components of the decoding system are the same as the one shown in FIG. 6*a* and hence a repeated description is omitted here.

The patch generator 110 receives the audio signal 105 from the AAC core decoder 360 and now performs the patching within the time domain to generate the raw signal 115, which is input into the spectral converter 120 (for example, an analysis QMF bank comprising 64 bands). Out of many possibilities, one patching algorithm in the time domain performed by the patch generator 110 results in a raw signal 115 comprising the doubled sample rate, if the patch generator 110 performs the patching by introducing additional samples between existing samples (which are close to zero values, for example). The output of the spectral converter 120 are the raw signal spectral representation 125, which are input into the raw signal adjuster 130, which again comprises the SBR tool 130*a* on the one hand and the envelope adjuster 130*b* on the other hand. As for the embodiments shown before the output of the envelope adjuster comprises the adjusted raw signal 135 which is combined with the audio signal in the frequency domain 105*f* in the combiner 140 which, again, comprises a synthesis QMF bank of 64 frequency bands, for example.

Hence, the main difference is that, e.g., the mirroring is performed in the time domain and the upper frequency data are already reconstructed before the signal 115 is input into the analysis 64 band filter bank 120 meaning that the signal already comprises the doubled sampled rate (in the dual rate SBR). After this patching operation, a normal SBR tool can be employed, which may again comprise an inverse filtering, adding a noise floor or adding missing harmonics. Although the reconstruction of the high frequency region occurs in the time domain an analysis/synthesis is performed in the QMF domain so that the remaining SBR mechanisms could still be used.

In the FIG. 6*c* embodiment, the patch generator advantageously outputs a full band signal comprising the low band signal and the high band signal (raw signal). Alternatively, the patch generator only outputs the high band portion e.g. obtained by high-pass filtering, and the QMF bank 120 is fed by the AAC core decoder output 105 directly.

In a further embodiment, the patch generator 110 comprises a time domain input interface and/or a time domain output interface (time-domain interface), and the processing within this block can take place in any domain such as a QMF domain or a frequency domain such as a DFT, FFT, DCT, DST or any other frequency domain. Then, the time domain input interface is connected to a time/frequency converter or generally a converter for converting from the time domain into a spectral representation. The spectral representation is, then, processed using at least two different patching algorithms operating on frequency domain data. Alternatively, a first patching algorithm operates in the frequency domain and a second patching algorithm operates in the time domain. The patched frequency domain data is converted back into a time domain representation, which is then input into block 120 via the time domain output interface. In the embodiment, in which the signal on line 115 does not comprise the full band, but only comprises the low band, the filtering is advantageously performed in the spectral domain before converting the spectral signal back into the time domain.

Advantageously, the spectral resolution in block 110 is higher than the spectral resolution obtained by block 120. In one embodiment, the spectral resolution in block 110 is at least twice as high as in the block 120.

By isolating the patching algorithm in a separate functional block, which is implemented by this embodiment, it is possible to apply arbitrary spectral replication methods completely independent from the use of the SBR tools. In an alternative implementation it is also possible to generate the high frequency component by patching in the time domain parallel to inputting the AAC decoder signal into a 32-band analysis filter bank. Base band and the patched signals will be combined only after the QMF analysis.

Figure 6D:
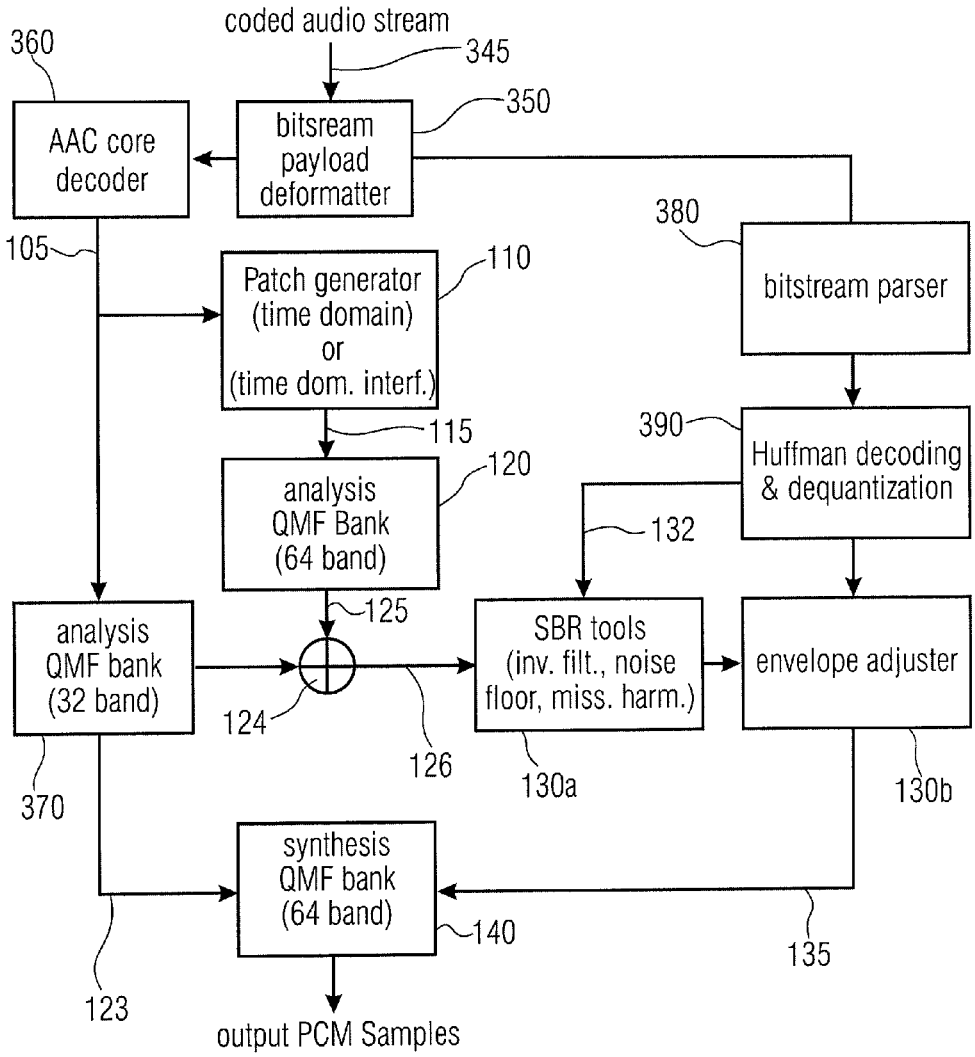

FIG. 6*d* shows such an embodiment, where the patching is performed within the time domain. Similar to the embodiment as shown in FIG. 6*c*, also in this embodiment the difference to the FIG. 6*a* comprises the position of the patch generator 110 as well as the analysis filter banks. In particular, the AAC core decoder 360, the bit stream payload deformatter 350 as well as the bit stream parser 380 and the Hoffman decoding and dequantization unit 390 are the same as in the embodiment as shown in FIG. 6*a* and again a repeated description is omitted here.

The embodiment as shown in FIG. 6*d* branches the audio signal 105 output by the decoder 360 and input the audio signal 105 in the patch generator 110 as well as into the analysis 32 band QMF bank 370. The analysis 32 band QMF bank 370 (further converter 370) generates a further raw signal spectral representation 123. The patch generator 110 again performs a patching within the time domain and generates a raw signal 115 input into the spectral converter 120 which again may comprise an analysis QMF filter bank of 64 bands. The spectral converter 120 generates the raw signal spectral representation 125, which in this embodiment comprises frequency components in the first frequency band 201 and the replicated frequency bands in the second or third frequency band 202, 203. This embodiment comprises furthermore an adder 124, adapted to add the output of the analysis 32 band filter bank 370 and raw signal spectral representation 125 to obtain a combined raw signal spectral representation 126. The adder 124 may in general be a combiner 124 configured also to subtract the base band components (components in the first frequency band 201) from the raw signal spectral representation 125. The adder 124 may hence be configured to add an inverted signal or alternatively may comprise an optional inverter to invert the output signal from the analysis 32 band filter bank 370.

After this exemplary subtraction of the frequency components in the base frequency band 201, the output is again input into the spectral band replication tool 130*a*, which, in turn, forwards the resulting signal to the envelope adjuster 130*b*. The envelope adjuster 130*b* generates again the adjusted raw signal 135 which is combined in the combiner 140 with the output of the analysis 32 band filter bank 370, so that the combiner 140 combines the patched frequency components (in the second and third frequency band 202 and 203, for example) with the base band components output by the analysis 32 band filter bank 370. Again, the combiner 140 may comprise a synthesis QMF filter bank of 64 bands yielding the synthesis audio signal comprising, for example, output PCM samples.

In the FIG. 6*d* embodiment, the patch generator advantageously outputs a full band signal comprising the low band signal and the high band signal (raw signal). Alternatively, the patch generator only outputs the high band portion e.g. obtained by high-pass filtering for feeding into block 120, and the QMF bank 370 is fed by the AAC output directly as shown in FIG. 6*d*. Furthermore, the subtractor 124 is not required and the output of block 120 is fed into block 130*a* directly, since this signal only comprises the high band. Additionally, the block 370 does not need the output to the subtractor 124.

In a further embodiment, the patch generator 110 comprises a time domain input interface and/or a time domain output interface (time-domain interface), and the processing within this block can take place in any domain such as a QMF domain or a frequency domain such as a DFT, FFT, DCT, MDCT, DST or any other frequency domain. Then, the time domain input interface is connected to a time/frequency converter or generally a converter for converting from the time domain into a spectral representation. The spectral representation is, then, processed using at least two different patching algorithms operating on frequency domain data. Alternatively, a first patching algorithm operates in the frequency domain and a second patching algorithm operates in the time domain. The patched frequency domain data is converted back into a time domain representation, which is then input into block 120 via the time domain output interface.

Advantageously, the spectral resolution in block 110 is higher than the spectral resolution obtained by block 120. In one embodiment, the spectral resolution in block 110 is at least twice as high as in the block 120.

The FIGS. 6*a* to 6*d* covered the decoder structure and especially the incorporation of the patch generator 110 within the decoder structure. In order that the decoder and especially the patch generator 110 is able to generate or replicate higher frequency components the encoder may transmit additional information to the decoder, wherein the additional information 112 on the one hand gives the control information, which can, for example be used to fix the patching algorithm and, in addition, the spectral band replication parameter 132 to be used by the spectral band replication tools 130*a*.

Further embodiments comprise also a method for generating a synthesis audio signal 145 having a first frequency band and a second replicated frequency band 202 derived from the first frequency band 201. The method comprises a performing at least two different patching algorithms, converting the raw signal 115 into a raw signal spectral representation 125, processing the raw signal spectral representation 125. Each patching algorithm generates a raw signal 115 having signal components in the second replicated frequency band 202 using an audio signal 105 having signal components in the first frequency band 201. The patching is performed such that one of the at least two different patching algorithms is selected in response to a control information 112 for a first time portion and the other of the at least two different patching algorithms is selected in response to the control information 112 for a second time portion different from the first time portion to obtain the raw signal 115 for the first and the second time portion. The processing of the raw signal spectral representation 125 is performed in response to spectral domain spectral band replication parameters 132 to obtain an adjusted raw signal spectral representation 135. Finally, the method comprises a combining of the audio signal 105 having signal components in the first band 201 or a signal derived from the audio signal 105 with the adjusted raw signal spectral representation 135 or with a further signal derived from the adjusted raw signal spectral representation 135 to obtain the synthesis audio signal 145.

Figure 7A:
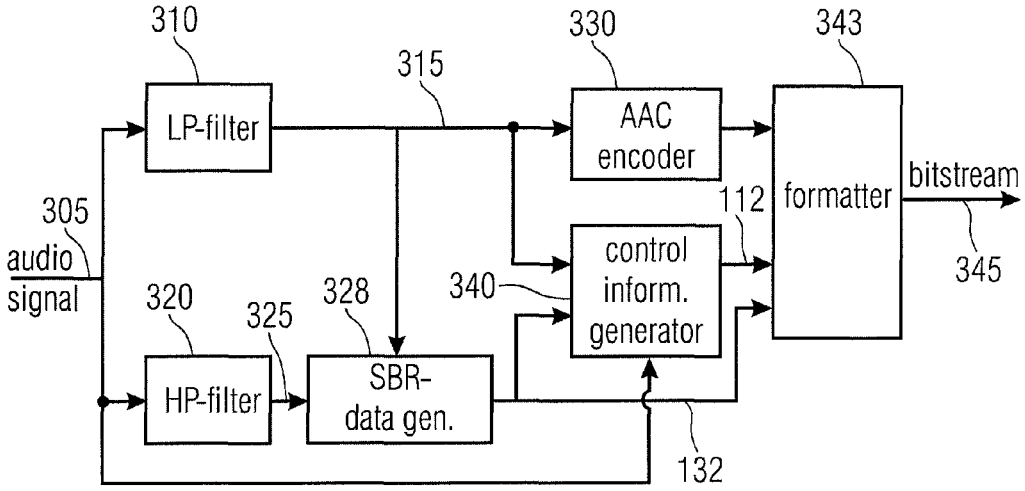
FIGS. 7*a* to 7*c* show block diagrams for an audio encoder according to further embodiments.
Figure 7B:
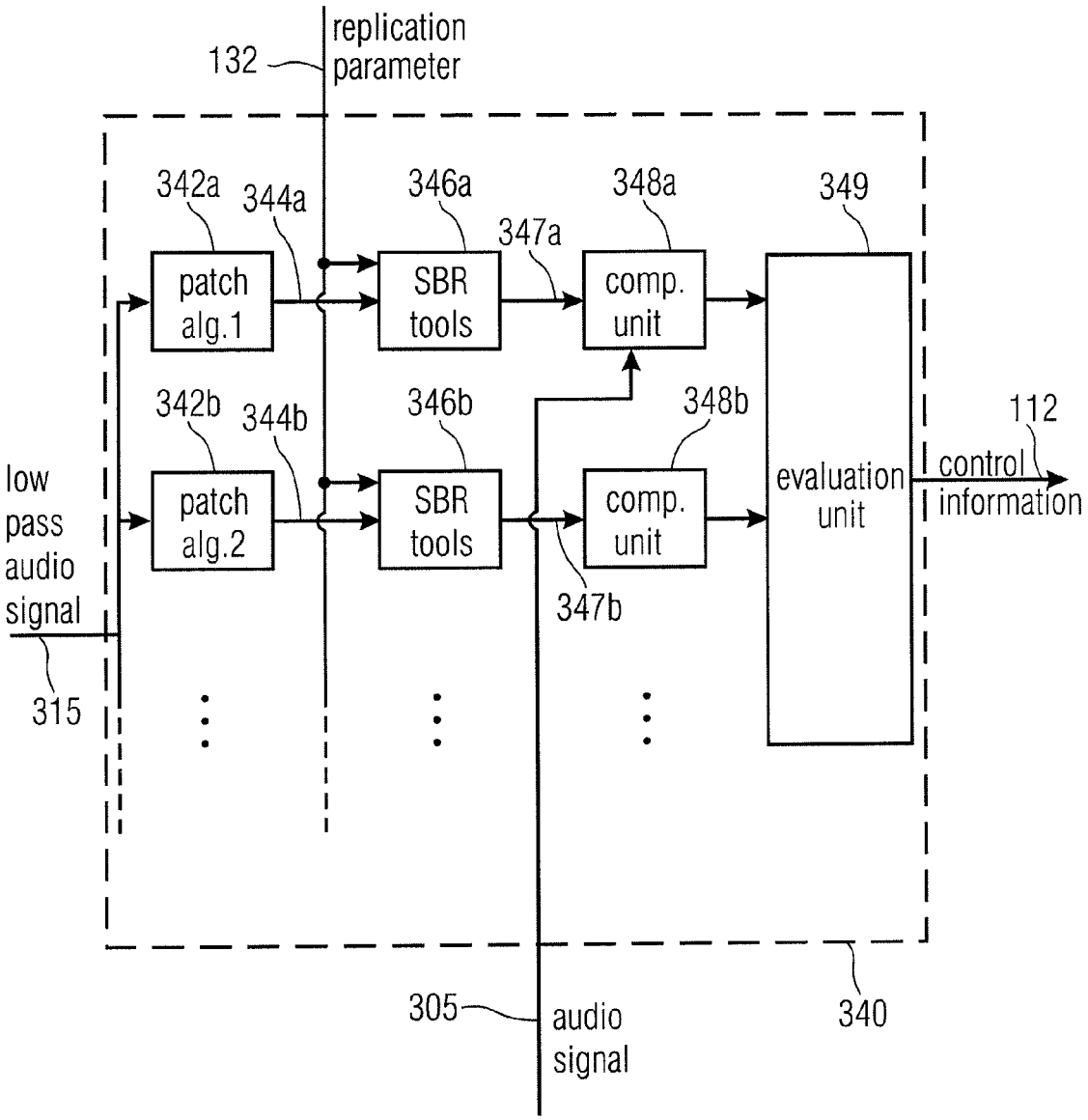
Figure 7C:
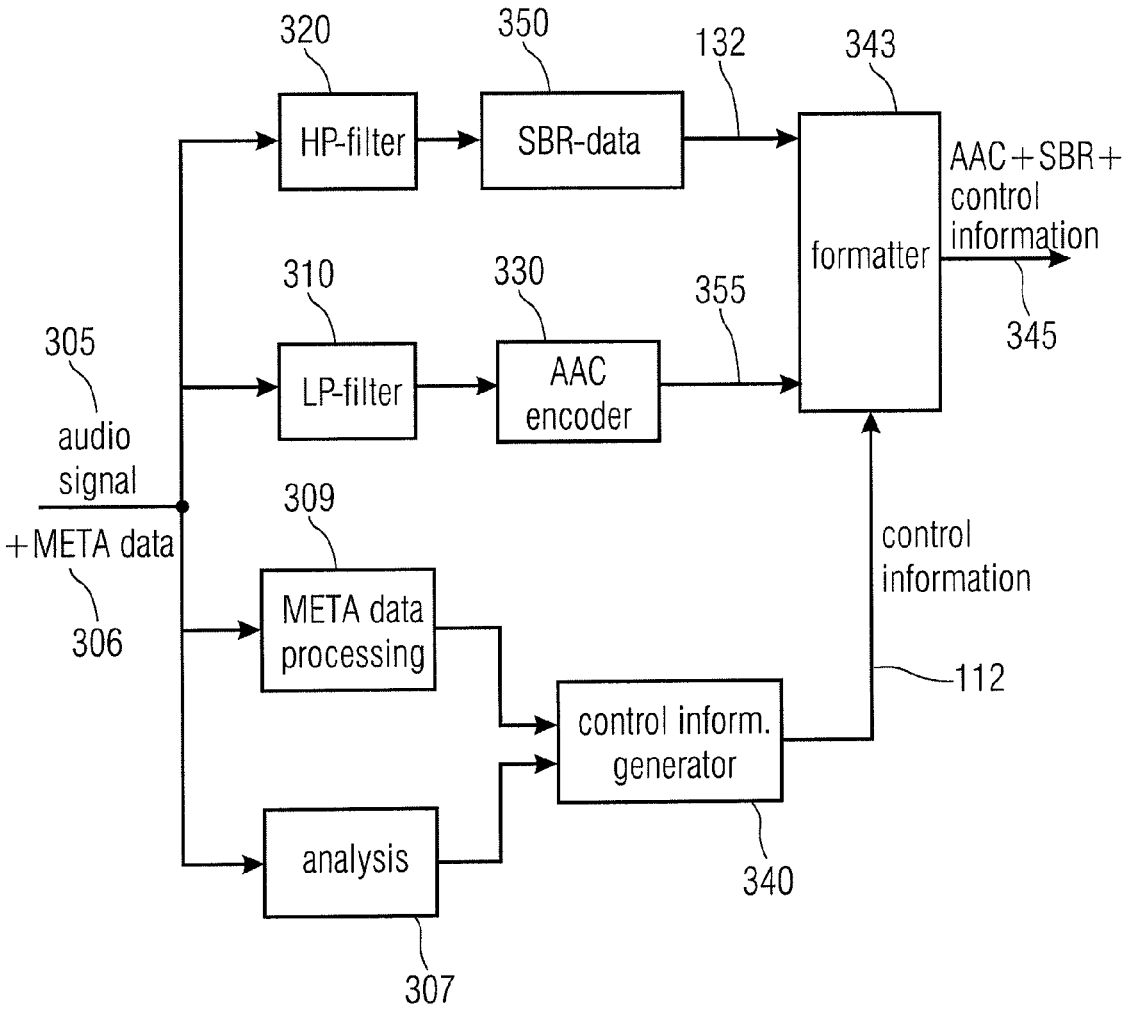

FIGS. 7*a*, 7*b* and 7*c* comprise embodiments of the encoder.

FIG. 7*a* shows an encoder encoding an audio signal 305 to generate the coded audio signal 345, which in turn is input into the decoders as shown in the FIGS. 6*a* to 6*d*. The encoder as shown in FIG. 7*a* comprises a low pass filter 310 (or a general frequency selective filter) and a high pass filter 320, in which the audio signal 305 is input. The low pass filter 310 separates the audio signal component within the first frequency band 201, whereas the high pass filter 320 separates the remaining frequency components, e.g. the frequency components in the second frequency band 202 and further frequency bands. Therefore, the low pass filter 310 generates a low pass filtered signal 315 and the high pass filter 320 outputs a high pass filtered audio signal 325. The low pass filtered audio signal 315 is input into an audio encoder 330, which may, for example, comprise an AAC encoder.

In addition, the low pass filtered audio signal 315 is input into a control information generator 340, which is adapted to generate the control information 112 so that an advantageous patching algorithm can be identified, which in turn is selected by the patch generator 110. The high pass filtered audio signal 325 is input into a spectral band data generator 328 which generates the spectral band parameters 132, which are input on one hand into the patch selector. The encoder of FIG. 7*a* comprises moreover a formatter 343 which receives the encoded audio signal from the audio encoder 330, the spectral band replication parameter 132 from the spectral band replication data generator 328, and the control information 112 from the control information generator 340.

The spectral band parameters 132 may depend on the patching method, i.e. for different patching algorithms the spectral band parameters may or may not differ, and it may not be necessary to determine the SBR parameter 132 for all patching algorithms (FIG. 7*c* below shows an embodiment, where only one set of SBR parameter 132 needs to be calculated). Therefore, the spectral band generator 328 may generate different spectral band parameters 132 for the different patching algorithms and thus the spectral band parameter 132 may comprise first SBR parameters 132*a* adapted to the first patching algorithm, second SBR parameters 132*b* adapted to the second patching algorithm, third SBR parameters 132*c* adapted to the third patching algorithm and so on.

FIG. 7*b* shows in more detail an embodiment for the control information generator 340. The control information generator 340 receives the low pass filtered signal 315 and the SBR parameters 132. The low pass filtered signal 315 may be input into a first patching unit 342*a*, into a second patching unit 342*b*, and other patching units (not shown). The number of patching units 342 may, for example, agree with the number of patching algorithms, which can be performed by the patch generator 110 in the decoder. The output of the patching units 342 comprises a first patched audio signal 344*a* for the first patching unit 342*a*, a second patched audio signal 344*b* for the second patch unit 342*b* and so on. The patched audio signals 344 comprising raw components in the second frequency band 202 are input into a spectral band replication tools block 346. Again, the number of spectral band replication tools blocks 346 may, for example, be equal to the number of patching algorithms or to the number of patching units 342. The spectral band replication parameters 132 are also input into the spectral band replication tools blocks 346 (SBR tools block) so that the first SBR tools block 346*a* receives the first SBR parameters 132*a* and the first patched signal 344*a*. The second SBR tools block 346*b* receives the second SBR parameters 132*b* and the second patched audio signal 344*b*. The spectral band replication tools blocks 346 generate the replicated audio signal 347 comprising higher frequency components within the second and/or third frequency bands 202 and 203 on the basis of the replication parameters 132.

Finally, the control information generator 340 comprises comparison units adapted to compare the original audio signal 305 and especially the higher frequency components of the audio signal 305 with the replicated audio signal 347. Again, the comparison may be performed for each patching algorithm so that a first comparison unit 348*a* compares the audio signal 305 with a first replicated audio signal 347*a* output by the first SBR tools block 346*a*. Similarly, a second comparison unit 348*b* compares the audio signal 305 with a second replicated audio signal 347*b* from the second SBR tools block 346*b*. The comparison units 348 determine a deviation of the replicated audio signals 347 in the high frequency bands from the original audio signal 305 so that finally an evaluation unit 349 can compare the deviation between the original audio signal 305 with the replicated audio signals 347 using different patching algorithms and determines from this an advantageous patching algorithm or a number of suitable or not suitable patching algorithms. The control information 112 comprise information, which allows identifying one of the advantageous patching algorithms. The control information 112 may, for example, comprise an identification number for the advantageous patching algorithm, which may be determined on the basis of the least deviation between the original audio signal 305 and the replicated audio signal 347. Alternatively, the control information 112 may provide a number of patching algorithms or a ranking of patching algorithms, which yield sufficient agreement between the audio signal 305 and the patched audio signal 347. The evaluation can, for example, be performed with respect to the perceptual quality so that the replicated audio signal 347 is, in an ideal situation for a human indistinguishable or close to be indistinguishable from the original audio signal 305.

FIG. 7*c* shows a further embodiment for the encoder in which, again, the audio signal 305 is input, but where optionally also meta data 306 are input into the encoder. The original audio signal 305 is again input into a low pass filter 310 as well as into a high pass filter 320. The output of the low pass filter 310 is, again, input into an audio encoder 330 and the output of the high pass filter 320 is input into a SBR data generator 328. The encoder comprises moreover a meta data processing unit 309 and/or an analysis unit 307 (or means for analyzing), whose output is sent to the control information generator 340. The meta data processing unit 309 is configured to analyze the meta data 306 with respect to an appropriate patching algorithm. The analysis unit 307 can, for example, determine the number and strength of transient or of pulse train or non-pulse train segments within the audio signal 305. Based on the output of the meta data processing unit 309 and/or the output of the analysis tool 307, the control information generator 340 can, again, determine an advantageous patching algorithm or generate a ranking of patching algorithm and encodes this information within the control information 112. The formatter 343 will again combine the control information 112, the spectral band replication parameter 132 as well as the encoded audio signal 355 within a coded audio stream 345.

The means for analyzing 307 provides, for example, the characteristic of the audio signal and may be adapted to identify non-harmonic signal components for a time portion having a degree of voice or a harmonic signal component for a distinguished time portion. If the audio signal 305 is purely speech or voice the degree of voice is high, whereas for a mixture of voice and, for example, music the degree of voice is lower. The calculation of the SBR parameter 132 can be performed dependent on this characteristic and the advantageous patching algorithm.

Yet another embodiment comprise a method for a data stream 345 comprising components of an audio signal 305 in a first frequency band 201, control information 112 and spectral band replication parameters 132. The method comprises a frequency selective filtering the audio signal 305 to generate the components of the audio signal 305 in the first frequency band 201. The method further comprises a generating of the spectral band replication parameter 132 from the components of the audio signal 305 in a second frequency band 202. Finally, the method comprises a generating of the control information 112 identifying an advantageous patching algorithm from a first or a second different patching algorithm, wherein each patching algorithm generates a raw signal 115 having signal components in the second replicated frequency band 202 using the components of the audio signal 305 in the first frequency band 201.

Although some embodiments specifically in FIGS. 6*a* to 6*d* have been illustrated so that the combination between low band and adjusted high band is performed in the frequency domain, it is to be noted that the combination can also be implemented in the time domain. To this end, the core decoder output signal can be used (at the output of a potentially useful delay stage for compensating a processing delay incurred by patching and adjusting) in the time domain and the high band adjusted in the filterbank domain can be converted into the time domain as a signal not having the low band portion and having the high band portion. In the FIG. 6 embodiment, this signal would only comprise the highest 32 subbands, and a conversion of this signal into the time domain results in a time domain high band signal. Then, both signals can be combined in the time domain such as by a sample-by-sample addition to obtain e.g. PCM samples as an output signal to be digital/analog converted and fed to a speaker.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal or bitstream can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed. Generally, embodiments of the present invention can be implemented as a computer program product with a program code, the program code being operative for performing one of the methods when the computer program product runs on a computer. The program code may for example be stored on a machine readable carrier. Other embodiments comprise the computer program for performing one of the methods described herein, stored on a machine readable carrier. In other words, an embodiment of the inventive method is, therefore, a computer program having a program code for performing one of the methods described herein, when the computer program runs on a computer. A further embodiment of the inventive methods is, therefore, a data carrier (or a digital storage medium, or a computer-readable medium) comprising, recorded thereon, the computer program for performing one of the methods described herein. A further embodiment of the inventive method is, therefore, a data stream or a sequence of signals representing the computer program for performing one of the methods described herein. The data stream or the sequence of signals may for example be configured to be transferred via a data communication connection, for example via the Internet. A further embodiment comprises a processing means, for example a computer, or a programmable logic device, configured to or adapted to perform one of the methods described herein. A further embodiment comprises a computer having installed thereon the computer program for performing one of the methods described herein. In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An audio signal synthesizer for generating a synthesis audio signal comprising a first frequency band and a second synthesized frequency band derived from the first frequency band, comprising:

a patch generator for performing at least two different patching algorithms, wherein each patching algorithm generates a raw signal comprising signal components in the second synthesized frequency band using an audio signal comprising signal components in the first frequency band, and wherein the patch generator is adapted to select one of the at least two different patching algorithms in response to a control information for a first time portion and another of the at least two different patching algorithms in response to the control information for a second time portion different from the first time portion to acquire the raw signal for the first and the second time portion outside of a spectral domain;

a spectral converter for converting the raw signal for the first and the second time portion from outside of a spectral domain into the spectral domain to acquire a raw signal spectral representation for the first and the second time portion;

a raw signal processor for processing the raw signal spectral representation for the first and the second time portion in response to spectral domain spectral band replication parameters to acquire an adjusted raw signal spectral representation for the first and the second time portion; and a combiner for combining one of the audio signal comprising signal components in the first band or a signal derived from the audio signal with one of the adjusted raw signal spectral representation or with a further signal derived from the adjusted raw signal spectral representation to acquire the synthesis audio signal, wherein at least one of the patch generator, the spectral converter, the raw signal processor, and the combiner comprises a hardware implementation.

2. The audio signal synthesizer of claim 1, in which the at least two patching algorithms are different from each other in that a signal component of the audio signal at a frequency in the first frequency band is patched to a target frequency in the second frequency band, and the target frequency is different for both patching algorithms.

3. The audio signal synthesizer of claim 1, in which the patch generator is adapted to operate in the time domain for both patching algorithms or in which the patch generator comprises a converter for converting a time-domain signal into a spectral representation, a converter for converting a signal in the spectral representation into the time domain and a time-domain output interface, wherein the patch generator is adapted to operate in the spectral domain for at least one patching algorithm.

4. The audio signal synthesizer of claim 1, in which the patch generator is adapted to generate the raw signal such that the raw signal comprises further signal components in the first frequency band comprising a sampling rate, which is greater than a sampling rate of the audio signal input into the patch generator, and wherein the spectral converter is adapted to convert signal components in the second frequency band and further signal components in the first frequency band into the raw signal spectral representation.

5. The audio signal synthesizer of claim 4, further comprising a further spectral converter and a further combiner, the further spectral converter is adapted to convert the audio signal comprising signal components in the first frequency band into a further raw signal spectral representation, and the further combiner is adapted to combine the raw signal spectral representation and the further raw signal spectral representation to acquire a combined raw signal spectral representation and wherein the raw signal processor is adapted to process the combined raw signal spectral representation.

6. The audio signal synthesizer of claim 5, wherein the combiner is adapted to use as the signal derived from the audio signal the further raw signal spectral representation.

7. The audio signal synthesizer of claim 1, wherein the audio signal and the control information are encoded in a data stream, further comprising a deformatter, the deformatter configured to acquire the control information from the data stream.

8. The audio signal synthesizer of claim 1, wherein the audio signal and the spectral band replication parameter are encoded in a data stream, and wherein the raw signal processor is adapted to acquire the spectral band replication parameter from the data stream.

9. A method for generating a synthesis audio signal comprising a first frequency band and a second replicated frequency band derived from the first frequency band, comprising:

performing, by a patch generator, at least two different patching algorithms, wherein each patching algorithm generates a raw signal comprising signal components in the second replicated frequency band using an audio signal comprising signal components in the first frequency band, and wherein the patching is performed such that one of the at least two different patching algorithms is selected in response to a control information for a first time portion and the other of the at least two different patching algorithms is selected in response to the control information for a second time portion different from the first time portion to acquire the raw signal for the first and the second time portion outside of a spectral domain;

converting, by a spectral converter, the raw signal for the first and the second time portion from outside of a spectral domain into the spectral domain to acquire a raw signal spectral representation for the first and the second time portion;

processing, by a raw signal processor, the raw signal spectral representation for the first and the second time portion in response to spectral domain spectral band replication parameters to acquire an adjusted raw signal spectral representation for the first and the second time portion; and combining, by a combiner, one of the audio signal comprising signal components in the first band or a signal derived from the audio signal with one of the adjusted raw signal spectral representation or with a further signal derived from the adjusted raw signal spectral representation to acquire the synthesis audio signal, wherein at least one of the patch generator, the spectral converter, the raw signal processor, and the combiner comprises a hardware implementation.

10. A non-transitory storage medium having stored thereon a computer program for performing, when running on a processor, a method for generating a synthesis audio signal comprising a first frequency band and a second replicated frequency band derived from the first frequency band, the method comprising:

performing at least two different patching algorithms, wherein each patching algorithm generates a raw signal comprising signal components in the second replicated frequency band using an audio signal comprising signal components in the first frequency band, and wherein the patching is performed such that one of the at least two different patching algorithms is selected in response to a control information for a first time portion and the other of the at least two different patching algorithms is selected in response to the control information for a second time portion different from the first time portion to acquire the raw signal for the first and the second time portion outside of a spectral domain;

converting the raw signal for the first and the second time portion from outside of a spectral domain into the spectral domain to acquire a raw signal spectral representation for the first and the second time portion;

processing the raw signal spectral representation for the first and the second time portion in response to spectral domain spectral band replication parameters to acquire an adjusted raw signal spectral representation for the first and the second time portion; and combining one of the audio signal comprising signal components in the first band or a signal derived from the audio signal with one of the adjusted raw signal spectral representation or with a further signal derived from the adjusted raw signal spectral representation to acquire the synthesis audio signal.

* * * * *